US011154965B2

(12) United States Patent
Hyma et al.

(10) Patent No.: US 11,154,965 B2
(45) **Date of Patent: *Oct. 26, 2021**

(54) LOCKING PLIERS WITH IMPROVED ADJUSTMENT MEMBER

(71) Applicant: Milwaukee Electric Tool Corporation, Milwaukee, WI (US)

(72) Inventors: Steven W. Hyma, Milwaukee, WI (US); Chen Zhang Li, Sussex, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 233 days.

This patent is subject to a terminal disclaimer.

(21) Appl. No.: 16/261,323

(22) Filed: Jan. 29, 2019

(65) Prior Publication Data

US 2019/0152023 A1 May 23, 2019

Related U.S. Application Data

(63) Continuation of application No. 15/378,546, filed on Dec. 14, 2016, now Pat. No. 10,207,394, which is a continuation of application No. 14/597,828, filed on Jan. 15, 2015, now abandoned.

(51) Int. Cl.
*B25B 7/12* (2006.01)

(52) U.S. Cl.
CPC ..... *B25B 7/123* (2013.01)

(58) Field of Classification Search
CPC ..... B25B 7/123
See application file for complete search history.

(56) References Cited

U.S. PATENT DOCUMENTS

| | | | |
|---|---|---|---|
| 1,156,764 | A | 10/1915 | Druck |
| 1,489,458 | A | 4/1924 | Petersen |
| 2,156,529 | A | 5/1939 | Dat |
| 2,280,005 | A | 4/1942 | Petersen |
| 2,388,580 | A | 11/1945 | Snell |
| 2,514,130 | A | 7/1950 | Jones |

(Continued)

FOREIGN PATENT DOCUMENTS

| | | |
|---|---|---|
| EP | 0216717 | 4/1987 |
| EP | 1237681 | 9/2002 |

(Continued)

OTHER PUBLICATIONS

Photographs of pliers taken on Sep. 19, 2012 (3 pages).

*Primary Examiner* — Hadi Shakeri
(74) *Attorney, Agent, or Firm* — Reinhart Boerner Van Deuren s.c.

(57) ABSTRACT

A hand tool includes a first jaw, a first handle fixed to the first jaw, a second jaw, and a second handle pivotally coupled to the second jaw, a link member, and an adjustment member. The adjustment member is operable to axially move a first end of the link member to vary a distance between the first and second jaws. The adjustment member includes an engagement surface engageable with the first end of the link member, a shank in threaded engagement with a bore in the first handle, and a flange extending from the shank opposite the engagement portion. The flange includes a first side, a second side opposite the first side, and an elongate opening extending through the first and second sides.

20 Claims, 4 Drawing Sheets

(56) References Cited

U.S. PATENT DOCUMENTS 2,519,630 A 8/1950 Boyer
RE24,465 E 4/1958 Waterbury
2,854,877 A 10/1958 Hunter
2,857,795 A 10/1958 Workman
3,698,419 A 10/1972 Tura
3,710,658 A 1/1973 Wilson
3,859,874 A 1/1975 Joeckel
3,894,451 A 1/1975 Putsch
D260,476 S 9/1981 Knaus
4,307,635 A 12/1981 Genova
4,519,278 A 5/1985 Heldt
4,850,254 A 7/1989 Burney
4,926,722 A 5/1990 Sorensen et al.
5,005,449 A 4/1991 Sorensen et al.
5,009,134 A 4/1991 Sorensen et al.
D320,919 S 10/1991 Sorensen
5,056,385 A 10/1991 Petersen
5,113,727 A 5/1992 Foster
D328,846 S 8/1992 Sorensen et al.
D331,180 S 11/1992 Sorensen
D333,602 S 3/1993 Gatzemeyer et al.
5,197,359 A 3/1993 Mills
D342,877 S 1/1994 Adamic
5,347,670 A 9/1994 Duguette et al.
5,351,585 A 10/1994 Leseberg et al.
D357,165 S 4/1995 Sorensen et al.
5,456,144 A 10/1995 Dahl et al.
5,460,065 A 10/1995 Balmer
D366,818 S 2/1996 McGarry
5,609,080 A 3/1997 Flavigny
5,640,876 A * 6/1997 Erwin ..... B25B 7/123 72/422
5,775,680 A 1/1998 Sorensen et al.
D398,208 S 9/1998 Anderson
5,813,297 A 9/1998 Zepkowski
D399,398 S 10/1998 Neyton
5,988,616 A 11/1999 Fuller et al.
6,019,352 A * 2/2000 Mayer ..... B21L 21/00 254/248
D426,440 S 6/2000 Torres
6,175,998 B1 1/2001 Leo
6,212,979 B1 4/2001 Wang
6,227,080 B1 5/2001 Grayo et al.
6,270,134 B1 8/2001 Lin
6,279,433 B1 8/2001 Chervenak
6,282,996 B1 9/2001 Berg et al.
6,302,386 B1 10/2001 Fuller et al.
6,311,588 B1 11/2001 St. John et al.
6,341,545 B1 1/2002 Gomas
6,347,791 B1 2/2002 Chervenak
6,378,404 B1 4/2002 Bally et al.
6,367,787 B1 7/2002 Poole et al.
6,412,767 B1 7/2002 Beckmann et al.
D462,247 S 9/2002 Hackman
6,450,070 B1 9/2002 Winkler et al.
D472,438 S 4/2003 Peperkorn et al.
6,591,719 B1 7/2003 Poole et al.
6,601,838 B1 8/2003 Gilley
6,626,070 B2 9/2003 Peperkorn et al.
6,776,072 B2 8/2004 Poole et al.
6,857,342 B2 2/2005 Wang
6,941,844 B2 9/2005 Hile
6,966,243 B1 11/2005 Liao
6,993,999 B2 2/2006 Wong
7,086,312 B1 8/2006 Tortolani
7,104,166 B1 9/2006 Wong
7,134,365 B2 11/2006 Hile
7,146,887 B2 12/2006 Hunter
D535,172 S 1/2007 Engvall et al.
D535,173 S 1/2007 Engvall et al.
D535,542 S 1/2007 Engvall et al.
7,249,542 B2 7/2007 McNatt
7,363,669 B2 4/2008 Berg et al.
D571,631 S 6/2008 Gandy, III
7,389,714 B1 6/2008 Heagerty
7,434,498 B2 10/2008 Johnson
7,454,999 B2 11/2008 Wu
7,472,632 B2 1/2009 Engvall et al.
7,509,895 B2 3/2009 Engvall et al.
D599,637 S 9/2009 Valencia
D605,917 S 12/2009 Sands
7,637,753 B2 12/2009 Wong et al.
7,641,183 B2 1/2010 Fuller et al.
7,651,078 B2 1/2010 Geier et al.
7,669,505 B2 3/2010 Campbell et al.
7,699,297 B2 4/2010 Cicenas et al.
7,721,630 B2 5/2010 Hunter
7,726,217 B2 6/2010 Engvall et al.
7,730,810 B1 6/2010 Janson
7,735,813 B2 6/2010 Geier et al.
7,815,175 B2 10/2010 Cicenas et al.
7,861,622 B2 1/2011 Chervenak et al.
7,896,322 B2 3/2011 Geler et al.
D635,427 S 4/2011 Chervenak et al.
D635,428 S 4/2011 Lucus
7,942,392 B2 5/2011 Geier et al.
7,954,794 B2 6/2011 Fuller et al.
7,984,895 B2 6/2011 Strauss et al.
8,024,998 B1 9/2011 Valencia
8,056,451 B2 11/2011 Chervenak et al.
D651,060 S 12/2011 Chervenak et al.
8,074,340 B2 12/2011 Cicenas et al.
D653,092 S 1/2012 Carra
8,122,792 B2 2/2012 Engvall et al.
8,176,814 B1 5/2012 Bernstein et al.
8,225,700 B2 7/2012 Hile
8,240,647 B2 8/2012 Geier et al.
8,266,990 B1 9/2012 Janson
8,270,134 B2 9/2012 Rogoll et al.
8,302,512 B2 11/2012 Shih
8,429,948 B1 4/2013 Warren
D682,067 S 5/2013 Tillet
8,479,618 B2 7/2013 Hsiao
D718,107 S 11/2014 Bascom
D724,926 S 3/2015 Hernandez, Jr. et al.
D771,456 S 11/2016 Hyma
9,492,911 B2 11/2016 Hyma et al.
2002/0157507 A1 10/2002 Chou
2003/0196526 A1 10/2003 Wang
2007/0131068 A1 6/2007 McNatt
2007/0180957 A1 8/2007 Johnson
2008/0173143 A1 7/2008 Wu
2008/0216615 A1 9/2008 Wu
2010/0084798 A1 4/2010 Geier et al.
2010/0018362 A1 9/2010 Chervenak et al.
2010/0218648 A1 9/2010 Chervenak et al.
2011/0067184 A1 3/2011 Robert
2011/0113935 A1 5/2011 Hall
2011/0203421 A1 8/2011 Chervenak et al.
2012/0096998 A1 4/2012 Shih
2013/0014618 A1 1/2013 Wu
2013/0047794 A1 2/2013 Huang
2013/0192429 A1 8/2013 Cripps
2013/0228046 A1 9/2013 Wu
2016/0207175 A1 7/2016 Hyma et al.
2017/0087695 A1 3/2017 Hyma et al.
2020/0094382 A1* 3/2020 Blumenthal ..... B25B 7/10

FOREIGN PATENT DOCUMENTS

TW M316129 8/2007
TW M387738 9/2010
TW D145453 2/2012
WO WO 9518699 7/1995

* cited by examiner

LOCKING PLIERS WITH IMPROVED ADJUSTMENT MEMBER

CROSS-REFERENCE TO RELATED APPLICATIONS

This application is a continuation of U.S. patent application Ser. No. 15/378,546, filed Dec. 14, 2016, which is a continuation of U.S. patent application Ser. No. 14/597,828, filed Jan. 15, 2015, the entire contents of both are hereby incorporated by reference herein.

FIELD OF THE INVENTION

The present invention relates to locking pliers and, more particularly, to a locking pliers having an improved adjustment member.

BACKGROUND

Locking pliers typically include a fixed jaw, a movable jaw, and an over-center linkage operable to lock the movable jaw in an adjustable position with respect to the fixed jaw.

SUMMARY

The invention provides, in one aspect, a hand tool including a first assembly including a first jaw and a first handle fixed to the first jaw, the first handle having a bore at an end opposite the first jaw, a second assembly pivotally coupled to the first assembly, the second assembly including a second jaw and a second handle pivotally coupled to the second jaw, a link member having a first end axially movable along the first assembly and a second end pivotally coupled to the second assembly, and an adjustment member operable to axially move the first end of the link member along the first assembly to vary a distance between the first and second jaws. The adjustment member includes an engagement surface engageable with the first end of the link member, a shank in threaded engagement with the bore, the shank defining a longitudinal axis, and a flange extending from the shank opposite the engagement portion. The flange includes a substantially planar first side, a substantially planar second side opposite the first side, and an elongate opening extending through the first and second sides. The elongate opening defines a first diameter coaxial with the longitudinal axis and a second diameter perpendicular to the longitudinal axis. The first diameter is greater than the second diameter.

The present invention provides, in another aspect, a method of clamping a workpiece between first and second jaws of a hand tool, the hand tool having a first assembly including the first jaw and a first handle fixed to the first jaw, a second assembly pivotally coupled to the first assembly and including the second jaw and a second handle pivotally coupled to the second jaw, a link member having a first end axially movable along the first assembly and a second end pivotally coupled to the second assembly, and an adjustment member having a threaded shank defining a longitudinal axis and a flange. The method includes pivoting the second handle towards the first handle to move the second jaw toward the workpiece, inserting a shank of a screwdriver through an elongate opening in a flange of the adjustment member, and applying force to the screwdriver to rotate the adjustment member, thereby axially moving the first end of the link member along the first assembly to move the second jaw further toward the workpiece and to increase a clamping force applied to the workpiece by the first and second jaws.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
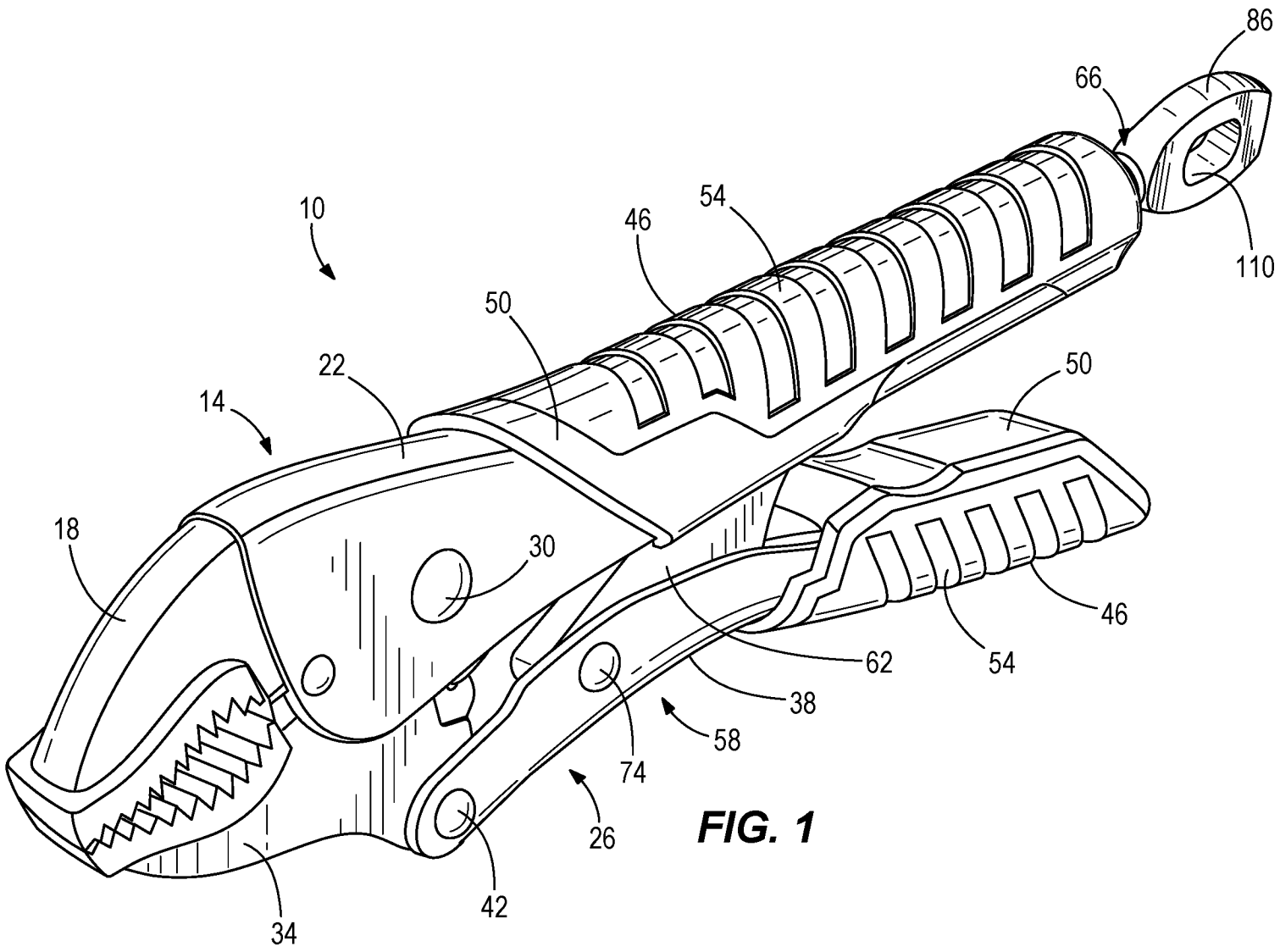
FIG. 1 is a perspective view of a locking pliers according to an embodiment of the invention.

FIG. 1 illustrates a hand tool in the form of a locking pliers 10. The pliers 10 includes a first assembly 14, which includes a first jaw 18 and a first handle 22 fixed to the first jaw 18. A second assembly 26 is pivotally coupled to the first assembly 14 at a first pivot point 30. The second assembly 26 includes a second jaw 34 and a second handle 38 pivotally coupled to the second jaw 34 at a second pivot point 42. As such, the handles 22, 38 are connected by a compound type pivot joint, and the handles 22, 38 pivot about the points 30, 42 to move the jaws 18, 34 between open and closed positions (i.e. to increase or decrease a distance between the jaws 18, 34). The illustrated jaws 18, 34 are curved pliers jaws; however, in other embodiments, the jaws 18, 34 may be C-shaped clamping arms or any type of jaws. The jaws 18, 34 are made of chrome plated, forged alloy steel for high durability and corrosion resistance. In other embodiments, the jaws 18, 34 can be made of other materials.

Figure 2:
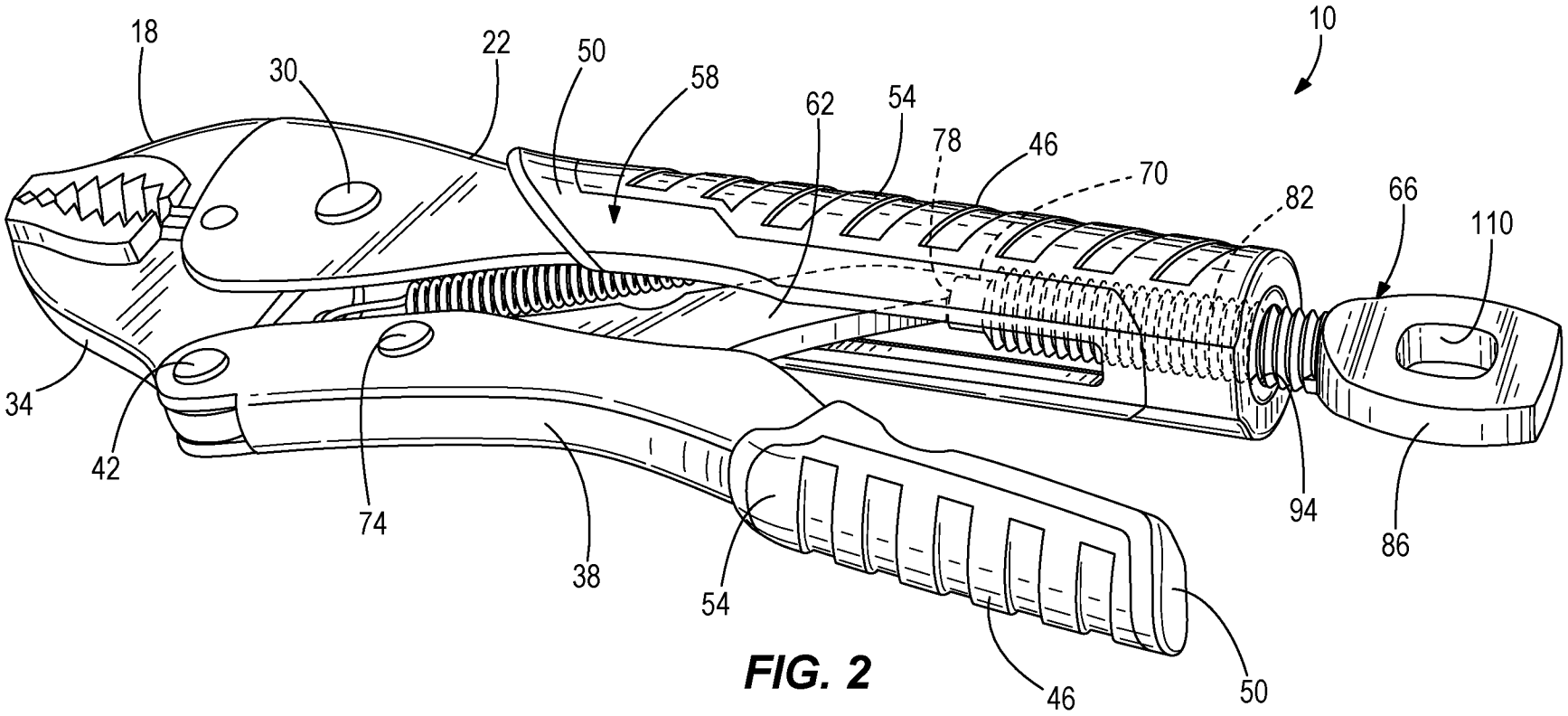
FIG. 2 is another perspective view of the locking pliers of FIG. 1.

With reference to FIGS. 1 and 2, the illustrated pliers 10 further includes grips 46 overmolded on the handles 22, 38 for improved user comfort. The grips 46 include a first, relatively hard, rigid material 50 and a second, relatively soft, pliable material 54. In other embodiments, the grips 46 can be made of a single material or can be omitted.

The pliers 10 includes a locking mechanism 58 that is operable to retain the pliers 10 in the closed position. The locking mechanism 58 includes a link member 62 and an adjustment member or control key 66. A first end 70 of the link member 62 is axially movable along the first assembly 14 and a second end of the link member 62 is pivotally coupled to the second assembly 26 at a third pivot point 74 (FIG. 2). In some embodiments, a release lever may be provided to release the pliers 10 from the locked closed position and allows the pliers 10 to move the open position.

Figure 3:
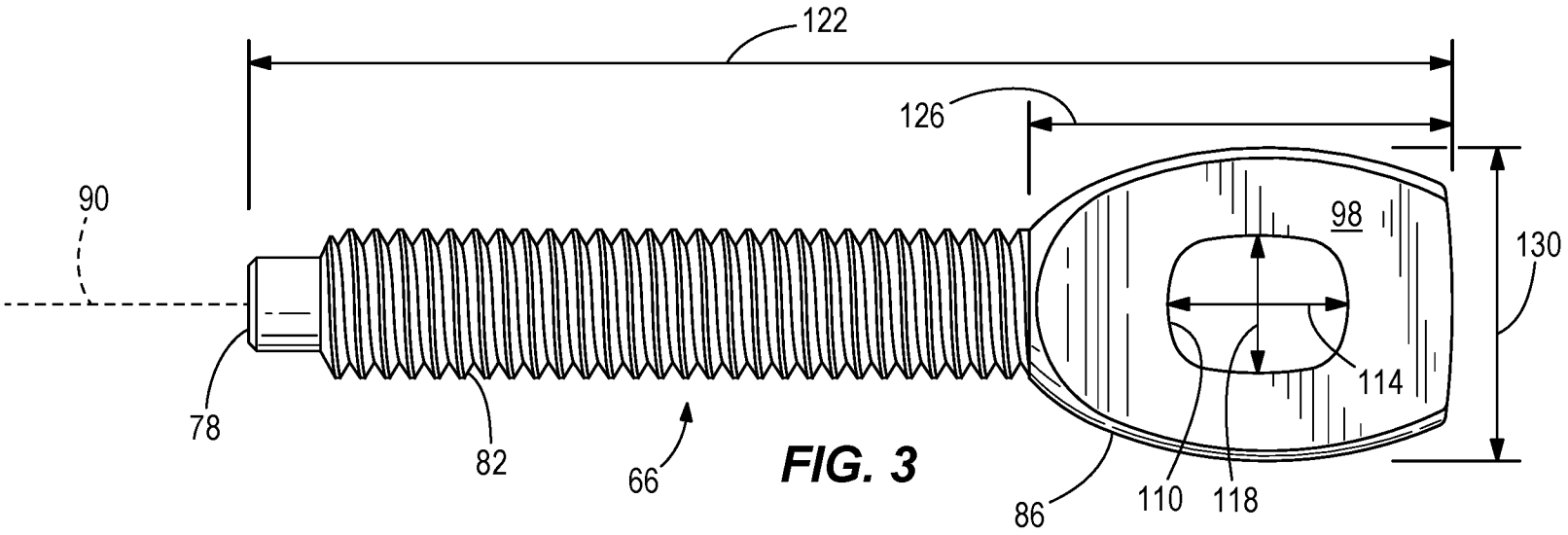
FIG. 3 is a side view of an adjustment member of the locking pliers of FIG. 1.

Referring to FIGS. 2 and 3, the adjustment member 66 includes an engagement surface 78 at one end, a threaded shank 82, and a flange 86 extending from the shank 82 opposite the engagement surface 78 (FIG. 3). The adjustment member 66 is integrally formed as a single component from metal such as by casting, forging, and the like. The threaded shank 82 defines a longitudinal axis 90 and is received by a threaded bore 94 in an end of the first handle 22 opposite the first jaw 18. The adjustment member 66 is rotatable relative to the first handle 22 to translate the adjustment member 66 in the axial direction (FIG. 2). Engagement between the engagement surface 78 and the first end 70 of the link member 62 causes the link member 62 to pivot about the third pivot point 74, adjusting the force the jaws 18, 37 exert on a workpiece when the pliers 10 is in the closed position.

Figure 4:
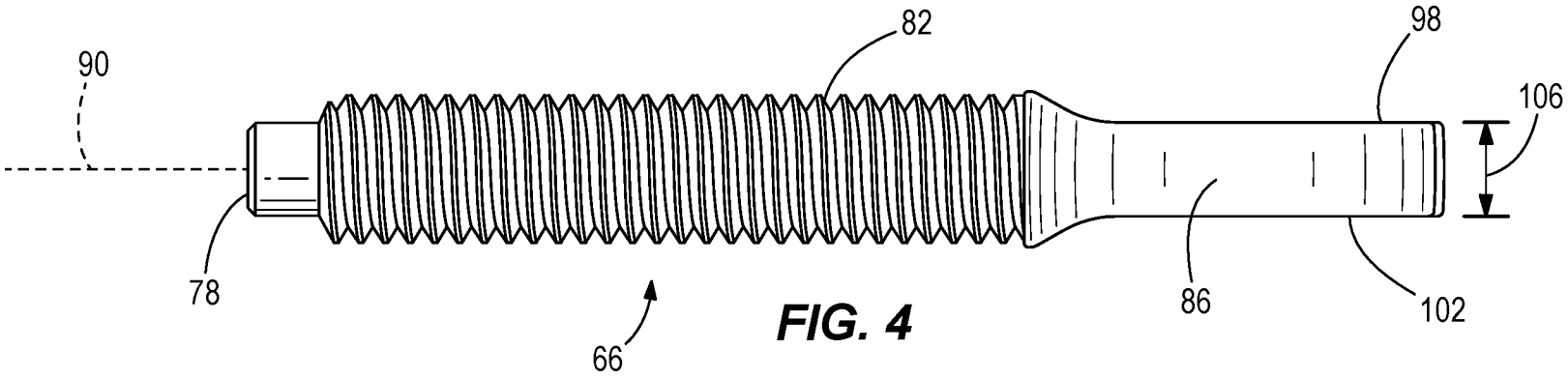
FIG. 4 is a top view of the adjustment member of FIG. 3.

With reference to FIGS. 3 and 4, the adjustment member 66 is sized and shaped to provide high strength and to facilitate user manipulation. The flange 86 is substantially flat, including a substantially planar first side 98 and a substantially planar second side 102 opposite the first side. The flange 86 defines a thickness 106 measured between the first and second sides 98, 102. In some embodiments, the thickness 106 is between about 4 millimeters and about 9 millimeters. Because the flange 86 is flat and relatively thick, it can be easily grasped between a user's fingers and turned by hand, even when the jaws 18, 34 are already locked on to a workpiece. In contrast, conventional knurled adjustment knobs are difficult to grip and turn when any appreciable resistance is encountered. The flat shape also allows the flange 86 to be securely gripped by a pliers, box wrench, and the like to assist the user with rotating the adjustment member 66 relative to the handle 22 to adjust the clamping force.

The adjustment member 66 further includes an elongate opening 110 that extends through the sides 98, 102. The opening 110 defines a first or major diameter 114 coaxial with the longitudinal axis 90, such that the opening 110 is centered with respect to the longitudinal axis 90. The opening 110 defines a second or minor diameter 118 perpendicular to the longitudinal axis 90. The minor diameter 118 is less than the major diameter 114, giving the opening 110 its elongate shape. In some embodiments, the minor diameter 118 is between about 6 millimeters and about 12 millimeters, and the major diameter 114 is between about 8 millimeters and about 16 millimeters. In some embodiments, a ratio of the minor diameter 118 to the major diameter 114 is between about 0.4 and about 0.9. The elongate opening 110 is sized to receive an elongated member 300, such as a shank of a screwdriver (FIG. 5), to assist the user with rotating the adjustment member 66 relative to the handle 22 to adjust the clamping force. The elongated shape allows the screwdriver or other elongated member 300 to be positioned accurately in an optimal position to evenly apply torque. The opening 110 can also be used to hang the pliers 10 when not in use.

The relative dimensions of the adjustment member 66 contribute to its strength, durability, and manufacturability. With reference again to FIGS. 3 and 4, the adjustment member 66 defines an overall length 122 measured from the engagement surface 78 to an end of the flange 86 opposite the engagement surface 78. In some embodiments, the overall length 122 is between about 50 millimeters and about 100 millimeters. The flange 86 also defines a flange length 126, measured from the end of the flange 86 to the shank 82, and a flange width 130 measured perpendicular to the thickness 106 and the flange length 126. In some embodiments, the flange length 126 is between about 19 millimeters and about 35 millimeters. In some embodiments, the flange width 130 is between about 14 millimeters and about 27 millimeters. In some embodiments, a ratio of the flange length 126 to the overall length 122 is between about 0.2 and about 0.7. In some embodiments, a ratio of the flange width 130 to the flange length 126 is between about 0.4 and about 1.4. In some embodiments, a ratio of the major diameter 114 to the flange length 126 is between about 0.2 and about 0.8. In some embodiments, a ratio of the minor diameter 118 to the flange width 130 is between about 0.2 and about 0.8.

Figure 5:
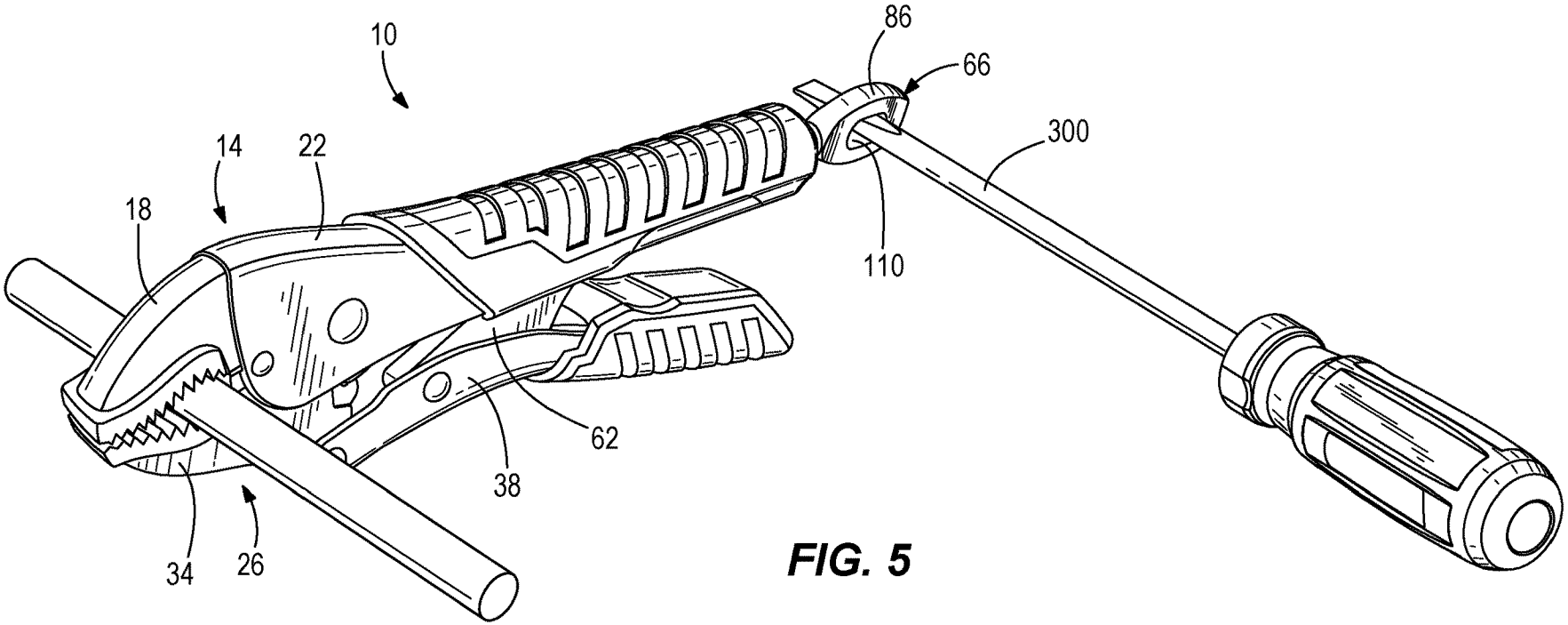
FIG. 5 is a perspective view of the locking pliers of FIG. 1 in use.

In operation, the user positions the jaws 18, 34 around a workpiece in the open position, then pivots the second handle 38 towards the first handle 22 to move the second jaw 34 toward the closed position. The user may then grasp the flange 86 and rotate the adjustment member 66 relative to the first handle 22 to decrease the distance between the jaws 18, 34 and thereby increase the clamping force when the jaws 18, 34 contact the workpiece. Where a high clamping force is desired, the user can insert an elongated member 300 through the elongate opening 110 to assist in rotating the adjustment member 66 while the jaws 18, 34 remain clamped on the workpiece (FIG. 5).

When using a typical locking pliers (not shown), a user must often guess at the correct adjustment setting when the jaws are open, then attempt to close the jaws on a workpiece. This process is repeated until the user determines the proper setting for the desired clamping force. With the improved adjustment member 66 of the illustrated pliers 10, the user can quickly and efficiently increase the clamping force exerted by the jaws 18, 34 on the workpiece while the jaws 18, 34 remain closed on the workpiece.

Various features of the invention are set forth in the following claims.

What is claimed is:

1. A hand tool comprising:

a first assembly including a first jaw and a first handle fixed to the first jaw, the first handle having a bore at an end opposite the first jaw;

a second assembly pivotally coupled to the first assembly, the second assembly including a second jaw and a second handle pivotally coupled to the second jaw;

a link member having a first end axially movable along the first assembly and a second end pivotally coupled to the second assembly; and an adjustment member operable to axially move the first end of the link member along the first assembly to vary a distance between the first and second jaws, the adjustment member including an engagement surface engageable with the first end of the link member, a shank in threaded engagement with the bore, the shank defining a longitudinal axis, and a flange extending from the shank opposite the engagement portion, the flange including a first side, a second side opposite the first side, and an elongate opening extending through the first and second sides, wherein the elongate opening defines a major dimension coaxial with the longitudinal axis and a minor dimension perpendicular to the longitudinal axis, wherein the major dimension is greater than the minor dimension, wherein the adjustment member defines an overall length measured from the engagement surface to an end of the flange opposite the engagement surface, wherein the flange defines a thickness measured between the first and second sides, wherein the flange defines a flange length measured from the end of the flange to the shank, and wherein the flange defines a flange width measured perpendicular to the thickness and the flange length, and wherein the minor dimension is between 6 millimeters and 12 millimeters, wherein the major dimension is between 8 millimeters and 16 millimeters, wherein the flange length is between 19 millimeters and 35 millimeters, wherein the flange width is between 14 millimeters and 27 millimeters.

2. The hand tool of claim 1, wherein the adjustment member is integrally formed as a single piece.

3. The hand tool of claim 1, wherein the elongate opening is sized to receive a screwdriver shank therethrough.

4. The hand tool of claim 1, wherein a ratio of the minor dimension to the major dimension is between 0.4 and 0.9.

5. The hand tool of claim 1, wherein a ratio of the flange length to the overall length is between 0.2 and 0.7.

6. The hand tool of claim 1, wherein a ratio of the flange width to the flange length is between 0.4 and 1.4.

7. The hand tool of claim 1, wherein a ratio of the major dimension to the flange length is between 0.2 and 0.8.

8. The hand tool of claim 1, wherein a ratio of the minor dimension to the flange width is between 0.2 and 0.8.

9. The hand tool of claim 1, wherein the overall length is between 50 millimeters and 100 millimeters.

10. The hand tool of claim 1, further comprising a first grip overmolded on the first handle and a second grip overmolded on the second handle.

11. The hand tool of claim 10, wherein at least one of the first grip and the second grip includes a first material and a second material, the second material being softer than the first material.

12. The hand tool of claim 1, wherein the first jaw and the second jaw are made of chrome plated forged alloy steel.

13. The hand tool of claim 1, wherein the major dimension is a major diameter and the minor dimension is a minor diameter.

14. The hand tool of claim 1, wherein the first side includes a substantially planar portion.

15. The hand tool of claim 14, wherein the second side includes a substantially planar portion.

16. A hand tool comprising:

a first assembly including a first jaw and a first handle fixed to the first jaw, the first handle having a bore at an end opposite the first jaw;

a second assembly pivotally coupled to the first assembly, the second assembly including a second jaw and a second handle pivotally coupled to the second jaw;

a link member having a first end axially movable along the first assembly and a second end pivotally coupled to the second assembly; and an adjustment member operable to axially move the first end of the link member along the first assembly to vary a distance between the first and second jaws, the adjustment member including an engagement surface engageable with the first end of the link member, a shank in threaded engagement with the bore, the shank defining a longitudinal axis, and a flange extending from the shank opposite the engagement portion, the flange including a first side, a second side opposite the first side, and an elongate opening extending through the first and second sides, wherein the elongate opening defines a major dimension coaxial with the longitudinal axis and a minor dimension perpendicular to the longitudinal axis, wherein the major dimension is greater than the minor dimension, wherein the adjustment member defines an overall length measured from the engagement surface to an end of the flange opposite the engagement surface, wherein the flange defines a thickness measured between the first and second sides, wherein the flange defines a flange length measured from the end of the flange to the shank, and wherein the flange defines a flange width measured perpendicular to the thickness and the flange length, wherein a ratio of the minor dimension to the major dimension is between 0.4 and 0.9, wherein a ratio of the flange length to the overall length is between 0.2 and 0.7, wherein a ratio of the flange width to the flange length is between 0.4 and 1.4, wherein a ratio of the major dimension to the flange length is between 0.2 and 0.8, and wherein a ratio of the minor dimension to the flange width is between 0.2 and 0.8.

17. The hand tool of claim 16, wherein the elongate opening is sized to receive a screwdriver shank therethrough, wherein the first jaw and the second jaw are made of chrome plated forged alloy steel.

18. The hand tool of claim 16, wherein the major dimension is a major diameter and the minor dimension is a minor diameter, wherein the first side includes a substantially planar portion, wherein the second side includes a substantially planar portion.

19. A hand tool comprising:

a first assembly including a first jaw and a first handle fixed to the first jaw, the first handle having a bore at an end opposite the first jaw;

a second assembly pivotally coupled to the first assembly, the second assembly including a second jaw and a second handle pivotally coupled to the second jaw;

a link member having a first end axially movable along the first assembly and a second end pivotally coupled to the second assembly; and an adjustment member operable to axially move the first end of the link member along the first assembly to vary a distance between the first and second jaws, the adjustment member including an engagement surface engageable with the first end of the link member, a shank in threaded engagement with the bore, the shank defining a longitudinal axis, and a flange extending from the shank opposite the engagement portion, the flange including a first side, a second side opposite the first side, and an elongate opening extending through the first and second sides, wherein the elongate opening defines a major dimension coaxial with the longitudinal axis and a minor dimension perpendicular to the longitudinal axis, wherein the major dimension is greater than the minor dimension, wherein the adjustment member defines an overall length measured from the engagement surface to an end of the flange opposite the engagement surface, wherein the flange defines a thickness measured between the first and second sides, wherein the flange defines a flange length measured from the end of the flange to the shank, and wherein the flange defines a flange width measured perpendicular to the thickness and the flange length, wherein the minor dimension is between 6 millimeters and 12 millimeters;

wherein the major dimension is between 8 millimeters and 16 millimeters; and wherein a ratio of the flange width to the flange length is between 0.4 and 1.4.

20. The hand tool of claim 19, wherein the first jaw and the second jaw are made of steel, wherein the first side includes a substantially planar portion, wherein the second side includes a substantially planar portion, and further comprising a first grip overmolded on the first handle and a second grip overmolded on the second handle, wherein at least one of the first grip and the second grip includes a first material and a second material, the second material being softer than the first material.

* * * * *